US005613248A

United States Patent [19]

Young

[11] Patent Number: 5,613,248

[45] Date of Patent: Mar. 25, 1997

[54] SWEATBAND FOR A HAT

[76] Inventor: Richard S. Young, 213 Wappoo Rd., Charleston, S.C. 29407

[21] Appl. No.: 554,700

[22] Filed: Nov. 7, 1995

[51] Int. Cl.[6] ..... A42C 5/02

[52] U.S. Cl. ..... 2/181.4; 2/181; 2/209.13

[58] Field of Search ..... 2/175.1, 181, 181.2, 2/181.4, 181.6, 182.1, 182.2, 182.3, 182.7, 182.8, 209.13, DIG. 11

[56] References Cited

U.S. PATENT DOCUMENTS

| | | |
|---|---|---|
| 3,578,736 | 10/1969 | Dootson . |
| 4,406,021 | 9/1983 | Bloom . |
| 4,468,817 | 9/1984 | Nunnery et al. . |
| 4,630,317 | 12/1986 | Brown et al. . |
| 5,181,277 | 1/1993 | Sherman . |
| 5,253,598 | 10/1993 | Rinehuls . |
| 5,315,714 | 5/1994 | Peters et al. ..... 2/209.13 |
| 5,317,761 | 6/1994 | Piche . |
| 5,432,955 | 7/1995 | Plotka et al. . |

FOREIGN PATENT DOCUMENTS

| | | |
|---|---|---|
| 124654 | 4/1919 | United Kingdom . |
| 428895 | 5/1935 | United Kingdom . |

*Primary Examiner*—Diana Biefeld
*Attorney, Agent, or Firm*—Richard C. Litman

[57] ABSTRACT

A sweatband for a hat, that can be easily inserted and removed, comprising a flexible retaining strip which permanently attached on one end to the inside surface of a hat, with the opposite end of the strip removably attached to the inside surface of the hat by means of a snap fastener, and a tubular sweatband, which, when the snap fastener is disengaged, can be inserted around the retaining strip, and thereby be retained in the hat when the snap fastener is engaged. The sweatband can also be easily removed to be cleaned or replaced by unfastening the removable end of the retaining strip.

17 Claims, 3 Drawing Sheets

SWEATBAND FOR A HAT

BACKGROUND OF THE INVENTION

1. Field of the Invention

The present invention relates to a tubular sweatband, with two opposite open ends, that fits inside a hat, and is retained on a flat strip fastened at one end to the inside of the hat, the strip being releasably snapped at an opposite end to the inside of the hat, so that the sweatband can be easily inserted and removed.

2. Description of the Prior Art

While there are numerous sweatbands in the prior art, none is equivalent to the present invention, by which the sweatband is retained inside the hat out of view, securely fastened around a strip, yet easily removed by unsnapping one end of the strip, so that it can be cleaned or replaced.

U.S. Pat. No. 3,578,736, issued to Norman L. Dootson, on Oct. 20, 1969, discloses a strip of paper and plastic to be inserted between a hat and a sweatband inside a hat. The sweatband is not wrapped around the strip, as in the instant invention.

U.S. Pat. No. 4,406,021, issued to Bernard Bloom, on Sep. 27, 1983, discloses an uniform cap with adjustable sweatband. There are holes in the sweatband, and its position can be adjusted by changing the position of studs that fit through the holes.

U.S. Pat. No. 4,468,817, issued to Merle W. Nunnery and Judith Noel, on Sep. 4, 1984, discloses a perspiration band for headgear, consisting of a washable terrycloth strip, with snap fasteners for attachment to hat bands. It is distinguishable from the instant invention in that the snaps are on the sweatband itself, rather than on a strip that the sweatband fits around.

U.S. Pat. No. 4,630,317, issued to Larry L. Brown and Jerry H. Lisle, on Dec. 23, 1986, discloses a sweatband apparatus, with a sweatband attached to the inside of a cap with hook and loop fasteners, e.g., VELCRO™.

U.S. Pat. No. 5,181,277, issued to Gary A. Sherman, on Jan. 26, 1993, discloses a reversible hat assembly, which includes a sweatband attached with hook and loop fasteners.

U.S. Pat. No. 5,253,598, issued to Hans Rinehuls, on Oct. 19, 1993, discloses a method for manufacturing hats, including a method of permanently installing sweatbands. The sweatbands are not removable, as in the instant invention.

U.S. Pat. No. 5,317,761, issued to Bradley Piche, on Jun. 7, 1994, discloses self-adhering absorbent disposable pads for headgear, which are distinguishable from the sweatband of the instant invention, in that they are not tubular and are attached with an adhesive substance.

U.S. Pat. No. 5,432,955, issued to Artur P. Plotka and Teresa Plotka, on Jul. 18, 1995, discloses a quick release reusable sweatband, which is retained on the inside of a cap by hook and loop fasteners.

British Patent No. 124,654, issued to Frederick Niblock, complete specification accepted Apr. 3, 1919, discloses a detachable sweatband for a sun helmet. It is distinguishable from the instant invention in that it includes a plurality of press stud fasteners in a circle on the inside of the helmet, rather than just a single snap fastener.

British Patent No. 428,895, issued to Frederick George Mitchell, complete specification accepted May 22, 1935, discloses an eye shade with a strip of absorbent material.

None of the above inventions and patents, taken either singly or in combination, is seen to describe the instant invention as claimed.

SUMMARY OF THE INVENTION

Accordingly, it is a principal object of the invention to provide a means for absorbing sweat from a hat wearer's forehead, which can easily be removed to be washed or replaced.

It is another object of the invention to provide a means for attaching a sweatband to the inside of a hat which is simple and economical.

It is a further object of the invention to provide a means for absorbing sweat on the inside of a hat which is lightweight and does not take up an excessive amount of space.

Still another object of the invention is to provide a means for attaching a sweatband to the inside of a hat so that it will not be externally visible.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a means for removably attaching a sweatband to the inside of a hat, and a hat with a sweatband so attached.

Figure 1:
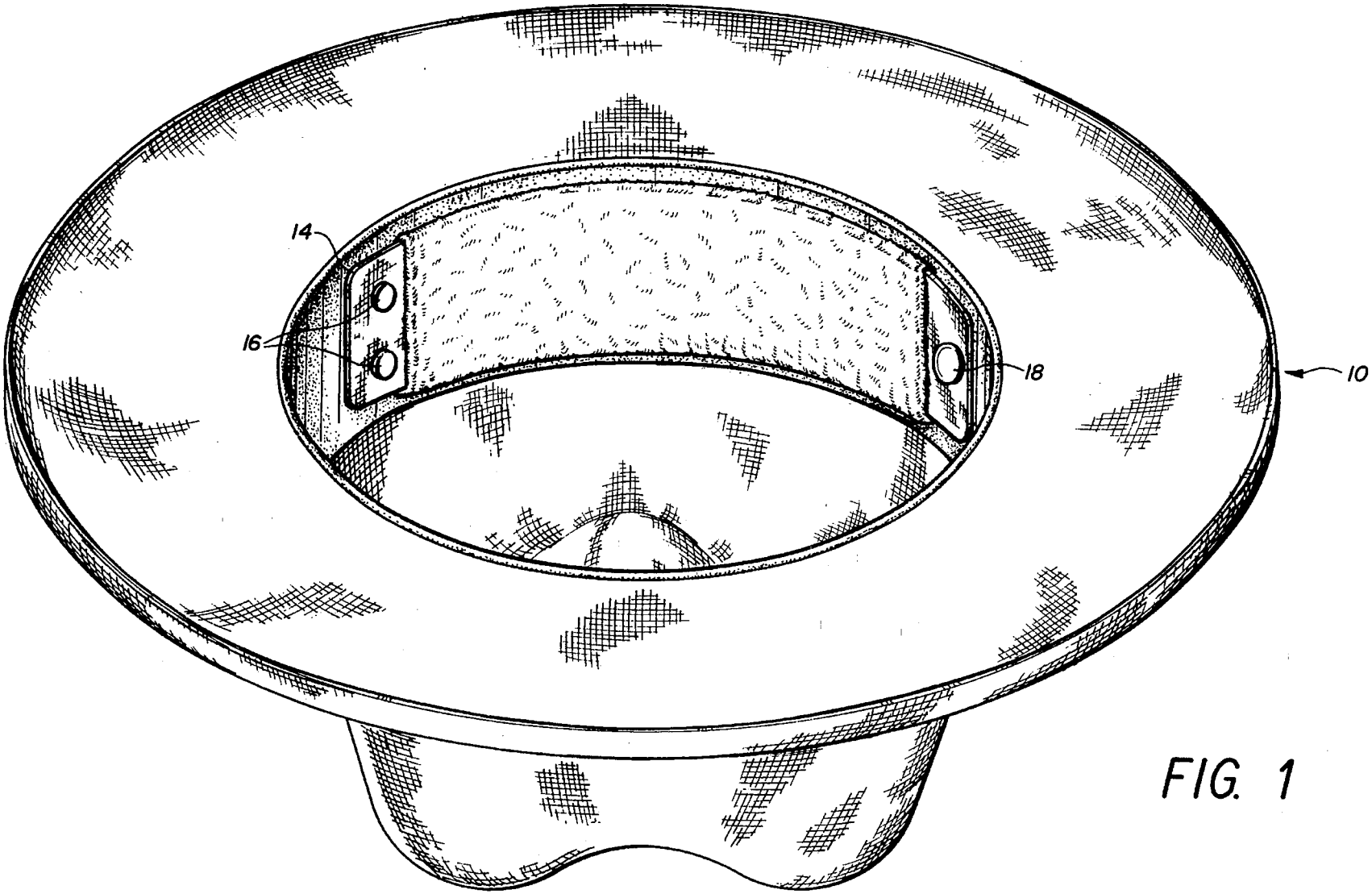
FIG. 1 is a perspective view of the invention attached to the inside of a hat.

FIG. 1 shows a hat 10 which is turned upside down to show a tubular sweatband 12, which has been placed around a leather or plastic retaining strip 14. The retaining strip may also be made of semi-rigid material. One end of the strip is permanently attached to the inside of the hat by means of rivets 16, and the other end of the strip is releasably attached to the inside of the hat by means of a removable fastener 18. The permanent attachment of one end of the strip by rivets is only one example of a suitable attachment. One end of the strip could also be permanently attached to the inside surface of the hat by sewing or by at least one staple. The removable fastener may take the form of a plurality of male/female snap fasteners, hook and loop fasteners, a button and hole fastener, or any means of releasably attaching the strip other end to the inside surface of the hat. In other words, one end of the flexible retaining strip can have a plurality of male or first parts of snap fasteners which matingly engage a plurality of corresponding female or second parts of snap fasteners disposed on the inside surface of the hat for removably attaching a sweatband thereto. Similarly, one end of the flexible retaining strip can have a plurality of first parts of hook and loop fasteners which matingly engage a plurality of corresponding second parts of hook and loop fasteners disposed on the inside surface of the hat for removably attaching a sweatband thereto.

Figure 2:
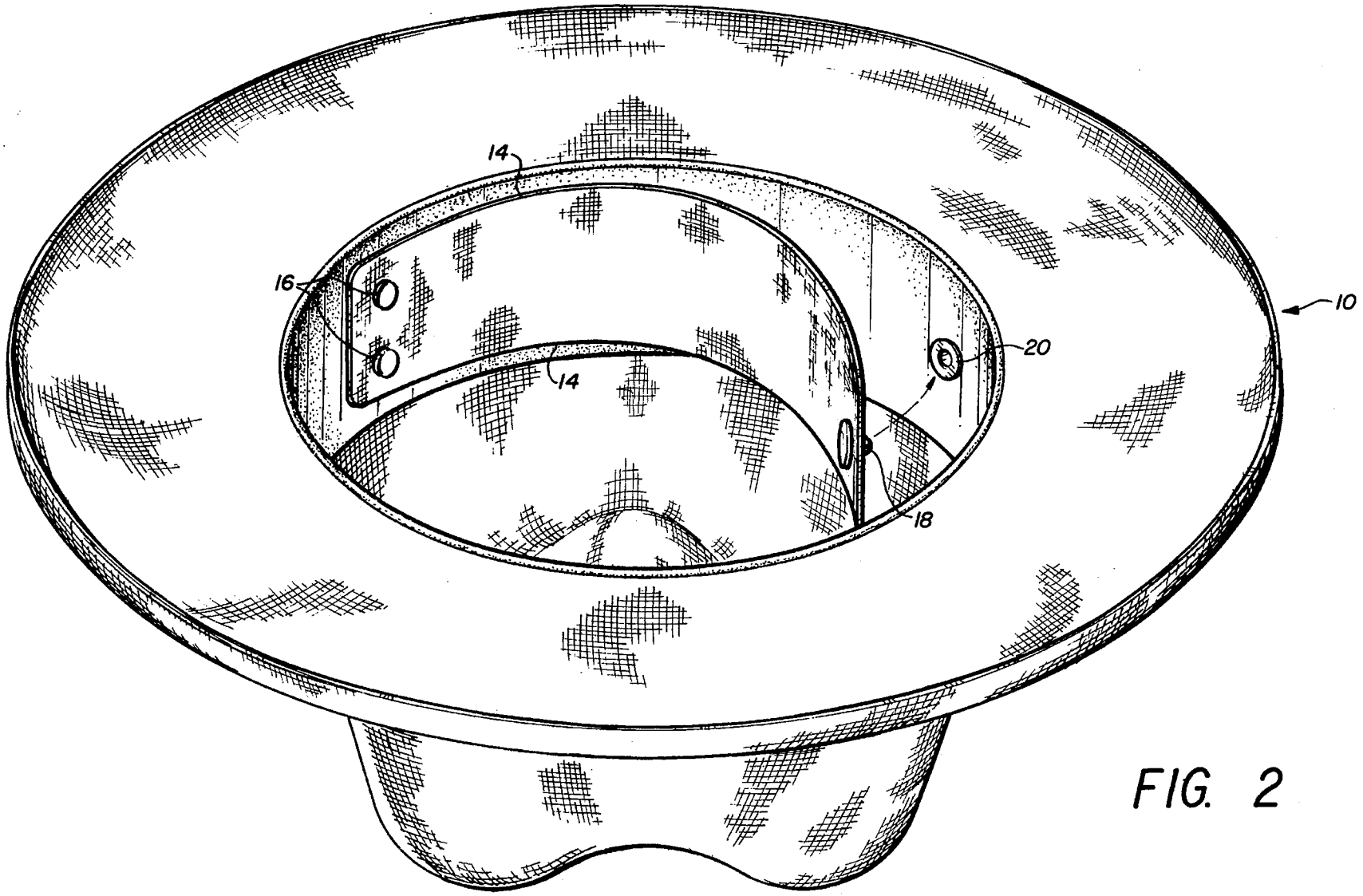
FIG. 2 is a perspective view of the fastening strip attached to the inside of a hat, with the sweatband removed.
Figure 3:
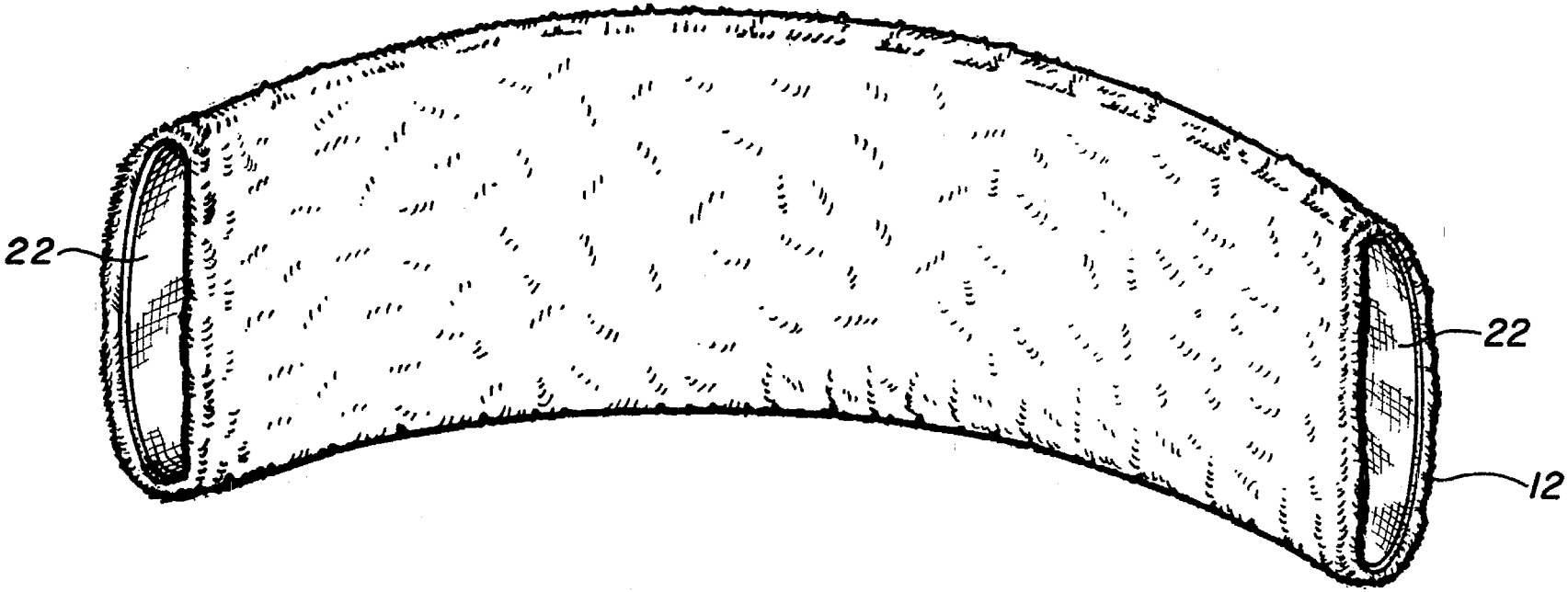
FIG. 3 is a perspective view of the sweatband.

FIG. 2 shows the hat with the sweatband removed from the retaining strip 14, with the male part of a removable fastener 18 attached to the strip released from the female part of the removable fastener 18 attached to the hat 20, so that the tubular sweatband can be detached from or inserted onto the strip. FIG. 3 shows the sweatband 12 by itself, made of an absorbent material, which is cut and sewn into a flattened tubular shape with open ends 22 so that it will fit around the strip.

When it is necessary to remove the sweatband, it can either be washed or replaced with a new sweatband. In the preferred embodiment, the sweatband is only placed in the area of the hat adjacent to the wearer's forehead, so as to minimize the space that it takes up, and to avoid requiring a larger hat size.

It is to be understood that the present invention is not limited to the embodiments described above, but encompasses any and all embodiments within the scope of the following claims.

I claim:

1. A hat with a sweatband, comprising:

a hat with an inside surface and an outside surface;

a flexible strip having a first end, a second end, and a middle portion, the strip being permanently attached on the first end to the inside surface of the hat, and the second end having a first part of a snap fastener which can matingly engage a corresponding second part of the snap fastener on the inside surface of the hat; and a tubular sweatband, which, when the first part and the second part of the snap fastener are disengaged, can be inserted around the middle portion of the flexible strip, and then be retained in the hat when the first part and the second part of the snap fastener are engaged.

2. The hat with a sweatband according to claim 1, wherein the flexible strip is made of plastic.

3. The hat with a sweatband according to claim 1, wherein the flexible strip is made of leather.

4. The hat with a sweatband according to claim 1, wherein the first end of the flexible strip is attached to the inside surface of the hat by means of at least one rivet.

5. The hat with a sweatband according to claim 1, wherein the first end of the flexible strip is attached to the inside surface of the hat by means of sewing.

6. The hat with a sweatband according to claim 1, wherein the first end of the flexible strip is attached to the inside surface of the hat by means of at least one staple.

7. The hat with a sweatband according to claim 1, wherein the second end of the flexible strip has a plurality of first parts of snap fasteners, which can matingly engage a plurality of corresponding second parts of said snap fasteners on the inside surface of the hat.

8. The hat with a sweatband according to claim 1, wherein the second end of the flexible strip has a plurality of first parts of hook and loop fasteners, which can matingly engage a plurality of corresponding second parts of said hook and loop fasteners on the inside surface of the hat.

9. A means for removably attaching a sweatband to a hat, in combination with a hat having a sweatband, comprising:

a flexible strip having a first end, a second end, and a middle portion, the strip being permanently attached on the first end to an inside surface of a hat, and the second end having a first part of a snap fastener which can matingly engage a corresponding second part of the snap fastener to be attached to the inside surface of the hat; and a tubular sweatband, which, when the first part and the second part of the snap fastener are disengaged, can be inserted around the middle portion of the flexible strip, and then be retained in the hat when the first part and the second part of the snap fastener are engaged.

10. The combination of claim 9, wherein the flexible strip is made of plastic.

11. The combination of claim 9, wherein the flexible strip is made of leather.

12. The combination of claim 9, wherein the flexible strip is made of a semi-rigid material.

13. The combination of claim 9, wherein the first end of the flexible strip is attached to the inside surface of the hat by means of at least one rivet.

14. The combination of claim 9, wherein the first end of the flexible strip is attached to the inside surface of the hat by means of sewing.

15. The combination of claim 9, wherein the first end of the flexible strip is attached to the inside surface of the hat by at least one staple.

16. The combination of claim 9, wherein the second end of the flexible strip has a plurality of first parts of snap fasteners, which can matingly engage a plurality of corresponding second parts of said snap fasteners on the inside surface of the hat.

17. The combination of claim 9, wherein the second end of the flexible strip has a plurality of first parts of hook and loop fasteners, which can matingly engage a plurality of corresponding second parts of said hook and loop fasteners on the inside surface of the hat.

* * * * *